US005750488A

United States Patent [19]

Haskell et al.

[11] Patent Number: 5,750,488

[45] Date of Patent: May 12, 1998

[54] FLUORINATED CLEANING SOLVENTS

[75] Inventors: Malcolm W. Haskell, Delran, N.J.; Richard Miller, Doylestown; Suzanne Zefferi, Morrisville, both of Pa.

[73] Assignee: CRC Industries, Inc., Warminster, Pa.

[21] Appl. No.: 582,820

[22] Filed: Jan. 4, 1996

[51] Int. Cl.[6] ..... C11D 7/30; C11D 7/50

[52] U.S. Cl. ..... 510/412; 510/161; 510/175; 510/406

[58] Field of Search ..... 510/406, 412

[56] References Cited

U.S. PATENT DOCUMENTS

| | | | |
|---|---|---|---|
| 1,833,429 | 11/1931 | Wheeler et al. | 510/185 |
| 2,562,384 | 7/1951 | Mannheimer et al. | 544/168 |
| 3,957,672 | 5/1976 | Zisman et al. | 510/364 |
| 4,096,083 | 6/1978 | Clementson et al. | 510/412 |
| 4,169,807 | 10/1979 | Zuber | 510/177 |
| 4,582,733 | 4/1986 | McCord | 510/177 |
| 4,873,015 | 10/1989 | Swan et al. | 510/178 |
| 5,045,119 | 9/1991 | Dohner | 510/412 |
| 5,059,728 | 10/1991 | Li et al. | 570/134 |
| 5,064,559 | 11/1991 | Merchant et al. | 252/67 |
| 5,064,560 | 11/1991 | Merchant | 252/67 |
| 5,073,288 | 12/1991 | Anton | 510/175 |
| 5,073,290 | 12/1991 | Anton et al. | 510/408 |
| 5,076,956 | 12/1991 | Anton | 510/480 |
| 5,100,572 | 3/1992 | Merchant | 252/67 |
| 5,162,384 | 11/1992 | Owens et al. | 521/110 |
| 5,196,137 | 3/1993 | Merchant | 252/67 |
| 5,221,361 | 6/1993 | Anton et al. | 510/177 |
| 5,225,099 | 7/1993 | Basu et al. | 510/408 |
| 5,268,122 | 12/1993 | Rao et al. | 510/411 |
| 5,275,669 | 1/1994 | Van Der Puy et al. | 134/42 |
| 5,288,422 | 2/1994 | Basu et al. | 510/408 |
| 5,290,473 | 3/1994 | Basu et al. | 510/409 |
| 5,298,083 | 3/1994 | Van Der Puy et al. | 134/42 |
| 5,304,322 | 4/1994 | Kuse | 510/183 |
| 5,352,375 | 10/1994 | Swan et al. | 510/409 |
| 5,401,429 | 3/1995 | Flynn et al. | 252/67 |
| 5,403,514 | 4/1995 | Matsuhisa et al. | 252/364 |
| 5,424,002 | 6/1995 | Omure et al. | 134/40 |
| 5,458,692 | 10/1995 | Matsuhisa et al. | 134/40 |
| 5,531,916 | 7/1996 | Merchant | 510/412 |

FOREIGN PATENT DOCUMENTS

| | | |
|---|---|---|
| 0 439 283 | 7/1991 | European Pat. Off. . |
| 0 465 037 | 1/1992 | European Pat. Off. . |

*Primary Examiner*—Ellen M. McAvoy

*Attorney, Agent, or Firm*—Panitch Schwarze Jacobs & Nadel, P.C.

[57] ABSTRACT

Cleaning compositions contain one or more fluorinated chemical and one or more acetal. The cleaning compositions have good volatility, low flammability, low toxicity, good cleaning ability, and do not harm the ozone layer.

21 Claims, No Drawings

FLUORINATED CLEANING SOLVENTS

FIELD OF THE INVENTION

The present invention relates to environmentally compliant cleaning compositions, and particularly to cleaning compositions low in ozone-depleting components.

BACKGROUND OF THE INVENTION

The cleaning of component parts prior to assembling a finished product is a necessary step in many manufacturing settings. For example, in the manufacture of electronic, telecommunication and other electrical equipment, it is often necessary to clean the component switches, circuits, boards, etc., prior to their assembly into a finished product. Clean equipment is essential for proper electrical conductivity of this type of equipment. In addition, when repairing such equipment, it is often necessary first to clean it. Furthermore, whenever two metal surfaces are to be joined together, it is highly desirable that the surfaces be free of grease and other contaminants.

Chlorofluorocarbons have been used extensively in a wide variety of cleaning compositions for such cleaning requirements. 1,1,2-Trichloro-1,2,2-trifluoroethane, or CFC-113, which is marketed by E. I. du Pont Nemours & Co. under the trademark Freon TF®, by Allied Signal under the trademark Genesolv D® and by Imperial Chemical Industries under the trademark Arklone P®, has been a particularly popular cleaner.

Chlorofluorocarbons have seen such extensive use because they offer an excellent balance of properties for a reasonable price. For example, they have low toxicity and flammability, high evaporation rate, leave little or not residue after evaporation, wide operational temperature range, and good compatibility with plastics and metals, i.e., they do not harm plastics and metals upon contact.

However, the manufacture and use of chlorofluorocarbons has been dramatically curtailed during the past few years as society has become concerned about the ability of chlorofluorocarbons to cause depletion of the earth's ozone layer. In many countries and regions of the world, the manufacture of chlorofluorocarbons has been, or soon will be banned by law.

Exemplary of the art directed to finding replacement for CFC-containing solvents is European Patent Application 0,465,037. The '037 application discloses solvent compositions comprising (a) a fluorine-free organic liquid, (b) a perfluorinated organic liquid and (c) a co-solvent which is miscible with components (a) and (b). Acetals are not disclosed by the '037 application as being useful components of solvent compositions.

Thus, there is a tremendous need to find suitable solvent compositions that have excellent solvency yet no undesirable handling or health concerns, and which are free of ozone-depleting chemicals such as chlorofluorocarbons.

SUMMARY OF THE INVENTION

The invention is directed to a solvent composition comprising (a) at least one fluorinated chemical of the formula $C_aF_bH_cN_dO_e$ wherein $2 \leqq a \leqq 8$, $5 \leqq b \leqq 18$, $0 \leqq c \leqq 13$, $0 \leqq d \leqq 2$ and $0 \leqq e \leqq 2$, and (b) at least one acetal of the formula $R^1—O—CHR^2—O—R^3$ wherein $R^1$ and $R^3$ are independently of the formula $C_fH_g$, $1 \leqq f \leqq 6$, $3 \leqq g \leqq 16$ and $R^2$ is hydrogen or has the formula $C_fH_g$.

DETAILED DESCRIPTION OF THE PREFERRED EMBODIMENTS

The invention is directed to cleaning compositions, and aerosol versions thereof, having at least two components, where the first component is a partially or completely fluorinated chemical and the second component is an acetal. The cleaning compositions of the invention are precision cleaners, which means that they are suitable for use where cleaning must be exact, mild, accurate and complete with no residue and no damage to the substrate.

The fluorinated chemical has the formula $C_aF_bH_cN_dO_e$ wherein $2 \leqq a \leqq 8$, $5 \leqq b \leqq 18$, $0 \leqq c \leqq 13$, $0 \leqq d \leqq 2$ and $0 \leqq e \leqq 2$. Thus, fluorinated chemicals useful in the invention include perfluorinated chemicals such as perfluoroalkanes, perfluorocycloalkanes, perfluoroethers, perfluorocycloethers, perfluorocycloaminoethers and the like, as well as partially fluorinated chemicals such as hydrofluorocarbons and hydrofluoroethers. The partially fluorinated chemicals preferably contain a fluorine:hydrogen atom ratio of at least about 1:1, preferably at least about 2:1.

A preferred fluorinated chemical is a perfluorinated chemical, i.e., where c is equal to 0. Among preferred perfluorinated chemicals are straight chain fluorocarbons containing only carbon and fluorine atoms, such as perfluoro-n-pentane, perfluoro-n-hexane, perfluoro-n-heptane and perfluoro-n-octane. Perfluoro-n-pentane is a particularly preferred straight chain fluorocarbon. Such fluorocarbons are commercially available or can be made by routes analogous to those used for commercially available homologs. For example, perfluoro-n-hexane ($C_6F_{14}$) is marketed by the 3M® Company of St. Paul, Minn. as PF 5060®, and perfluoro-n-pentane is also marketed by 3M Company as PF 5050®.

Another preferred fluorinated chemical is a perfluorinated cycloaminoether as described, e.g., in U.S. Pat. Nos. 5,162,384 and 5,401,429, where the entire disclosures of these two patents are hereby incorporated by reference. Perfluoro-N-methylmorpholine is a preferred perfluorinated cycloaminoether, and is available commercially from 3M Company as PF® 5052.

Suitable partially fluorinated chemicals include hydrofluorocarbons, also known as HFCs, where preferred HFCs include 1,1,1,2,3,4,4,5,5,5-decafluoropentane (HFC 4310 mee® from Du Pont Company, Wilmington, Del.) and 1,1,1,3,3-pentafluoropentane (HCFC 245 from AlliedSignal Corp., Morristown, N.J.). Perferred perfluorinated and partially flourinated chemicals have boiling points greater than the boiling point of the acetal.

The second essential component of the cleaning composition of the invention is at least one acetal of the formula $R^1—O—CHR^2—O—R^3$ wherein $R^1$ and $R^3$ are independently of the formula $C_fH_g$ wherein $1 \leqq f \leqq 6$ and $6 \leqq g \leqq 16$, and $R^2$ is hydrogen or has the formula $C_fH_g$. Preferred acetals have $1 \leqq f \leqq 3$.

A preferred acetal is known as methylal or dimethoxymethane, and has the CAS number 109-87-5. Methylal is available from several commercial supply houses, including Aldrich Chemical Company (Milwaukee, Wis.) and Lambiotte et Cie, Brussels, Belgium. It is preferred to use high purity acetal rather than technical grade. In general, acetals may be prepared by reacting an aldehyde of the formula $R^2—CHO$ with two equivalents of alcohol, according to technology that is very well known in the art.

The fluorinated chemical constitutes roughly at least about 75% of the weight of the entire composition, and the acetal component constitutes no more than about 20% of the entire composition. More preferably, the fluorinated chemical constitutes about 80–90% of the entire composition, and the acetal constitutes about 5–12% of the composition.

The cleaning composition of the invention may also, and preferably does contain ingredients in addition to the fluorinated chemical and the acetal. Alcohols, aldehydes, ketones and hydrocarbons are exemplary optional components for the composition of the invention. When present, these flammable components are preferably lower boiling than the fluorinated chemical.

Alcohols suitable for inclusion in the inventive composition include methanol, ethanol, n-propanol, isopropanol, butanol, sec-butanol, tert-butanol and isobutanol. Aldehydes and ketones suited for inclusion in the inventive composition include those of the formula $R^4$—C(=O)—$R^5$ wherein $R^4$ and $R^5$ are independently hydrogen, methyl, ethyl, n-propyl and iso-propyl. Hydrocarbons suited for inclusion in the inventive composition are preferably petroleum distillates with from about 5 to about 9 carbon atoms, i.e., $C_5$–$C_9$ hydrocarbons, e.g., pentane, hexane, isohexane, cyclohexane, heptane, isoheptane and the like.

Because the boiling point of the composition is preferably no more than about 80° C., high molecular weight alcohols, aldehydes, ketones and hydrocarbons are not preferred for the inventive composition. When present, the total of the alcohols, aldehydes, ketones and hydrocarbons should constitute no more than about 20 weight percent of the entire formulation. Hydrocarbons, because of their relatively lower density and higher flammability, are preferably present at no more than about 10 weight percent, and preferably are at about 3 to about 8 percent of the composition. If the total concentration of alcohols, aldehydes, ketones and hydrocarbon becomes too great, then the cleaning composition becomes undesirably flammable. The cleaning composition need not be an azeotropic composition.

Chlorinated chemicals are preferably not present in the cleaning composition of the invention, and monoethers are also preferably not present, although of course either can be present in some instances. 1,1-Dichloro-2,2,2-trifluoroethane (Du Pont, Wilmington, Del.) is a suitable chlorinated chemical that may be present in the inventive cleaning composition.

A preferred solvent composition of the invention consists of about 20–30 weight percent perfluoro-N-methylmorpholine, about 10–20 weight percent perfluoropentane, about 40–50 weight percent 1,1,1,2,3,4,4,5,5,5-decafluoropentane and about 15–20 weight percent of methylal. Another preferred solvent composition of the invention consists of about 80–90 weight percent perfluoro-N-methylmorpholine, about 5–12 weight percent methylal and about 1–10 weight percent of $C_5$–$C_9$ hydrocarbon.

A further preferred solvent composition of the invention consists of about 40–50 weight percent perfluoro-N-methylmorpholine, about 30–50 weight percent 1,1,1,2,3,4,4,5,5,5-decafluoropentane and about 5–12 weight percent methylal. Optionally, the further preferred solvent composition contains about 1–10 weight percent methanol.

Cleaning compositions of the invention can meet a number of criteria that render them well suited for use as a cleaning solvent for many industrial settings. For example, they are not flammable when tested by the Flame Projection Test and Closed Drum Test, both as set forth in Aerosol Guide, issued by Chemical Specialties Manufacturing Association (CSMA, Washington, D.C.), "Revised Flammability Test Methods For Aerosol Products", pages 11–12, 5th Ed., 1966. The Flame Projection Test provides a flame projection, also called a flame extension value, where lower values are preferred and a value of zero is most preferred.

The compositions of the invention are also not flammable according to the Cylinder Ignition Test performed as follows. An automobile ignition coil is wired to a battery (typically a 6 Volt, dry cell lantern battery). A 20 ounce (590 mL) steel aerosol can with the top dome removed is punctured to provide six holes (ca. 3–4 mm in diameter) evenly spaced around the can 1 cm from the bottom. An automobile spark plug is placed in the center of the bottom dome of the can with the electrodes approximately 1.5–2 cm above the inside of the dome. The can is mounted vertically with the spark plug at the bottom. A candidate composition is sprayed into the top opening of the can for 5 seconds (or 3.3 mL for non-aerosol forms of the candidate). A spark is applied to the can every 15 seconds after introducing the candidate composition. After the first minute, the spark frequency is reduced to once every 30 seconds, and this is performed until all the solvent has evaporated. If a flash is seen in the can before or upon reaching dryness, then the candidate composition fails the test. If no flash is seen, the composition passes the test.

In addition, compositions of the invention have excellent cleaning ability, measured by the Fluorescent Dye Test as follows. Both sides of an aluminum panel measuring about 2.5×3 inches (ca. 60 mm×75 mm, available from the Q Panel Company and commonly called Q panels), are cleaned using CFC 113. The panel is then wiped with a paper towel to ensure that the surfaces are clean. One drop of a "soil" composition consisting of LP 100 Oil (Exxon Chem., Houston, Tex.) with 1% Pylam SC131® fluorescent yellow dye (Pylam Products, Garden City, N.Y.) is spread evenly over one surface of the panel. The panel is then wiped two times with firm vertical strokes using a folded Kimwipe® to leave a very thin, evenly distributed layer of oil on the panel. The panel is observed under a black light to ensure that one entire surface of the panel is coated with the soil composition. The coated panel is placed on a flat surface, and an aerosol preparation of the candidate cleaning composition is directed at the panel in a steady stream for 5 seconds. The can containing the candidate cleaning composition should be positioned so that the tip of the extension tube is about 3 inches from the surface of the panel, and the candidate composition should be directed to a single spot on the panel. The panel is then placed on its side to dry, and after drying is qualitatively evaluated under a black light by a panel of individuals to determine the amount of fluorescent oil that was removed. A cleaning percent value is obtained by averaging the determinations made by each panel member.

Furthermore, cleaning compositions of the invention can pass the Bellcore Stressed Plastic Test (sometimes called the Bellcore Stress Cracking Procedure) on Lexan® Grade 141 (polycarbonate, GE Plastics), Cyclolac® Grade T (acrylonitrile-butadiene-styrene) and Noryl® Grade SE1 (modified polyphenylene ether, Du Pont, Wilmington, Del.). Details regarding the Bellcore Stressed Plastic Test are available from Bell Communications Research, Florham Park, N.J. as test method TR-620-23352-84-3. In essence, a candidate cleaner composition is placed on a sample of plastic (having a stressed applied thereon), and the plastic monitored for cracking and crazing over a two day period. If a candidate composition does not harm the plastic, then it passes the Bellcore Stressed Plastic Test.

In addition, cleaning compositions of the invention have very low toxicity, e.g., they have a TLV of greater than 250 ppm. They are fast evaporating, e.g., they have a boiling point of about 15° C. to about 80° C., preferably of about 30° C. to about 65° C. They are preferably liquid within the temperature range of 15° C. and 80° C., at a pressure of about 1 atmosphere, and still more preferably are a single phase homogeneous liquid under the stated temperature and pressure conditions. Finally, and very importantly, they have a low ozone depletion potential, e.g., below 0.1 on a scale where CFC11 has a rating of 1.0.

The cleaning composition of the invention may be prepared simply by combining the desired ingredients and mixing. The order of addition, the rate of stirring, etc., are not particularly critical. The cleaning composition of the invention can be placed into a container and dispensed by aerosol. Technology for producing aerosol cans of a cleaning composition are well known in the art and need not be repeated here. Any propellant suitable for propelling liquid compositions from a can may be used according to the invention. Suitable propellants include chlorofluorocarbons like dichlorodifluoromethane, hydrochlorofluorocarbons like chlorodifluoromethane, hydrofluorocarbons like 1,1,1,2-tetrafluoroethane, ethers like dimethyl ether and hydrocarbons like propane, butane and isobutane and carbon dioxide. The propellant is present as less than about 50 weight percent, and preferably at a concentration of about 3–35 weight percent based on the total weight of cleaning composition and propellant.

The cleaning composition of the invention are well-suited for use in a variety of situations. For example, they can be used in the cleaning procedures set forth in the following U.S. patents, where the entire disclosures of each are incorporated herein by reference: U.S. Pat. Nos. 5,176,757; 5,143,652; 5,089,152; 5,082,503; 5,055,138; 3,957,531; and 3,904,430. Thus, the cleaners of the instant invention can be used to clean electronic articles such as printed circuit boards, magnetic media, disk drive heads, avionics and the like, as well as medical articles such as syringes and surgical equipment. They are particularly effective as degreasing solvents. They may be used in ultrasonic cleaners, in agitated or non-agitated cleaning baths, and in refluxing cleaning baths or otherwise at elevated temperature.

The following examples are set forth as a means of illustrating the present invention and are not to be construed as a limitation thereon.

EXAMPLE 1

A 100 g composition was prepared consisting of 43 weight percent perfluoro-N-methylmorpholine, (PF 5052 from 3M Company, St. Paul, Minn.), 40 weight percent 1,1,1,2,3,4,4,5,5,5-decafluoropentane (HFC 4310 mee from Du Pont Company, Wilmington Del.) and 17 weight percent methylal (Lambiotte et Cie, Brussels, Belgium).

The composition was evaluated for its cleaning ability according to the Fluorescent Dye Test as described previously. The composition was able to remove approximately 48% of the oil coating from the aluminum panel. The flame extension according to the Flame Projection Test was zero (0), and the composition passed the Cylinder Ignition Test

EXAMPLE 2

A composition was prepared consisting of 45 weight percent PF 5052®, 40 weight percent HFC 4310 mee, 10 weight percent methylal and 5 weight percent methyl alcohol (Ashland Chemical, Columbus, Ohio). The composition was evaluated for its cleaning ability as described in Example 1, and had a cleaning ability of 18%. It also had a flame extension value of zero (0).

EXAMPLE 3

A composition was prepared consisting of 88 weight percent PF 5052®, 8 weight percent methylal and 4 weight percent isohexane (Exxon, Houston, Tex.). The composition was a single phase and had a cleaning ability according to the procedure described in Example 1 of 55%. It also passed the Cylinder Ignition Test.

EXAMPLE 4

A composition was prepared consisting of 25 weight percent PF 5052®, 15 weight percent perfluoropentane (PF 5050 from 3M Company, St. Paul, Minn), 43 weight percent HFC 4310 mee and 17 weight percent methylal. The composition was evaluated for its cleaning ability as described in Example 1, and had a cleaning ability of 48%. It had a flame extension of zero (0), passed the Cylinder Ignition Test and passed the Bellcore Stressed Plastic Test.

EXAMPLE 5

A one-phase composition consisting of 86 weight percent PF 5052®, 7 weight percent methylal and 7 weight percent isohexane was tested for its cleaning ability according to the procedure described in Example 1. It had a cleaning ability of 54%. It also had a flame extension value of zero (0) and passed the Cylinder Ignition Test.

COMPARATIVE EXAMPLE 1

A composition consisting of 75 weight percent PF 5052 and 25 weight percent HFC 4310 was prepared and its cleaning ability tested according to the procedure described in Example 1. It had a cleaning ability of less than 10%.

COMPARATIVE EXAMPLE 2

A composition consisting of 50 weight percent PF 5052 and 50 weight percent HFC 4310 was prepared and its cleaning ability tested according to the procedure described in Example 1 It had a cleaning ability of less than 10%.

COMPARATIVE EXAMPLE 3

A composition consisting of 25 weight percent PF 5052 and 75 weight percent HFC 4310 was prepared and its cleaning ability tested according to the procedure described in Example 1. It had a cleaning ability of less than 10%.

COMPARATIVE EXAMPLE 4

A mixture of 66 weight percent perfluorohexane, 5 weight percent ethanol and 29 weight percent 1,3-bis (trifluoromethyl)benzene was prepared. The mixture was 2-phases and thus could neither be formed into an aerosol nor could its cleaning ability be accurately determined.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A solvent composition comprising (a) at least one fluorinated chemical of the formula $C_aF_bH_cN_dO_e$ wherein $2 \leqq a \leqq 8$, $5 \leqq b \leqq 18$, $0 \leqq c \leqq 13$, $0 \leqq d \leqq 2$ and $0 \leqq e \leqq 2$, and (b) at least one acetal of the formula $R^1$—O—$CHR^2$—O—$R^3$ wherein $R^1$ and $R^3$ are independently of the formula $C_fH_g$ in which $1 \leqq f \leqq 6$ and $3 \leqq g \leqq 16$ and $R^2$ is hydrogen or has said formula $C_fH_g$ wherein said acetal is present in an amount of from about 5% to about 20% by weight, based on the weight of the solvent composition and, further, wherein said solvent composition passes a Flame Projection Test.

2. The solvent composition of claim 1 wherein $4 \leqq a \leqq 8$, $10 \leqq b \leqq 18$, c=0, d=0 and e=0.

3. The solvent composition of claim 1 wherein $1 \leqq f \leqq 3$.

4. The solvent composition of claim 1 which is a single liquid phase at a temperature in the range of 15° C. to 80° C. and one atmosphere pressure.

5. The solvent composition of claim 1 wherein the fluorinated chemical is selected from the group consisting of perfluoropentane, perfluoro-N-methylmorpholine, 1,1,1,2,3,4,4,5,5,5-decafluoropentane, 1,1,1,3,3-pentafluoropropane and 1,1-dichloro-2,2,2trifluoroethane.

6. The solvent composition of claim 1 which does not contain a chlorinated chemical.

7. The solvent composition of claim 1 wherein the acetal is methylal.

8. The solvent composition of claim 1 having a boiling point of about 15° C. to about 80° C.

9. The solvent composition of claim 1 having a boiling point of about 30° C. to about 65° C.

10. The solvent composition of claim 1 wherein the fluorinated chemical constitutes at least about 75 weight percent of the composition.

11. The solvent composition of claim 1 wherein the fluorinated chemical constitutes about 80 weight percent to about 90 weight percent of the composition and the acetal constitutes about 5 weight percent to about 12 weight percent of the composition.

12. The solvent composition of claim 1 further comprising an alcohol co-solvent selected from the group consisting of methanol, ethanol, n-propanol, iso-propanol, butanol, sec-butanol, tert-butanol and iso-butanol.

13. The solvent composition of claim 1 further comprising an aldehyde or ketone cosolvent having the formula $R^4$—C(=O)—$R^5$ where $R^4$ and $R^5$ are independently hydrogen, methyl, ethyl, n-propyl and iso-propyl.

14. The solvent composition of claim 1 further comprising a $C_5$–$C_9$ hydrocarbon.

15. The solvent composition of claim 1 consisting essentially of about 20–30 weight percent perfluoro-N-methylmorpholine, about 10–20 weight percent perfluoropentane, about 40–50 weight percent 1,1,1,2,3,4,4,5,5,5-decafluoropentane and about 15–20 weight percent of methylal.

16. The solvent composition of claim 1 consisting essentially of about 80–90 weight percent perfluoro-N-methylmorpholine, about 5–12 weight percent methylal and about 1–10 weight percent of $C_5$–$C_9$ hydrocarbon.

17. The solvent composition of claim 1 consisting essentially of about 40–50 weight percent perfluoro-N-methylmorpholine, about 30–50 weight percent 1,1,1,2,3,4,4,5,5,5-decafluoropentane and about 5–12 weight percent methylal.

18. The solvent composition of claim 17 further consisting essentially of about 1–10 weight percent methanol.

19. The solvent composition of claim 1 which passes a Bellcore Stressed Plastic Test on polycarbonate, acrylonitrlle-butadiene-styrene and modified polyphenylene ether.

20. The solvent composition of claim 1 which passes a Cylinder Ignition Test.

21. The solvent composition of claim 1 which demonstrates at least about 15% cleaning ability according to a Fluorescent Dye Test.

* * * * *